US006149556A

United States Patent [19]

Jordan

[11] Patent Number: 6,149,556

[45] Date of Patent: Nov. 21, 2000

[54] MULTILEVEL DUMBBELL SUPPORT APPARATUS

[76] Inventor: Duke M. Jordan, 824 Central Ave. #102, Charleston, W. Va. 25302

[21] Appl. No.: 09/208,683

[22] Filed: Dec. 10, 1998

[51] Int. Cl.[7] ..... A63B 13/00

[52] U.S. Cl. ..... 482/104; 482/108; 482/106

[58] Field of Search ..... 482/104–108

[56] References Cited

U.S. PATENT DOCUMENTS

| | | | |
|---|---|---|---|
| 4,666,150 | 5/1987 | Segrist et al. | 482/108 |
| 5,141,480 | 8/1992 | Lennox et al. | 482/104 |
| 5,314,394 | 5/1994 | Ronan | 482/104 |
| 5,346,448 | 9/1994 | Sollo | 482/104 |
| 5,411,459 | 5/1995 | Hayden | 482/104 |
| 5,468,203 | 11/1995 | Okonkwo | 482/104 |
| 5,472,397 | 12/1995 | Ammoscato | 482/104 |
| 5,616,108 | 4/1997 | Hayden | 482/104 |
| 5,788,616 | 8/1998 | Polidi | 482/104 |

*Primary Examiner*—Jerome W. Donnelly
*Attorney, Agent, or Firm*—Steptoe & Johnson

[57] ABSTRACT

A multilevel dumbbell support apparatus is disclosed having a base, a pair of front vertical supports and a pair of rear vertical supports, wherein the front vertical supports are connected to the rear vertical supports and all of the vertical supports are rigidly mounted to the base, thereby forming a single frame structure that is adapted for use with a weight lifting bench. The multilevel dumbbell support apparatus incorporates one or more dumbbell supports adjustably connected to the front vertical supports. Each dumbbell support comprises a front lip portion, a flat portion, and a rear inclined portion, wherein the front lip portion and the flat portion have an opening cut therein to accommodate a lifter's hand when grasping a dumbbell disposed thereon. The front lip portion has a height that is low enough so as to not interfere with a lifter racking a dumbbell, but high enough so as to store a dumbbell on the flat portion. The rear inclined portion is angled such that the dumbbell support acts as a silent partner to the lifter.

13 Claims, 2 Drawing Sheets

MULTILEVEL DUMBBELL SUPPORT APPARATUS

BACKGROUND OF THE INVENTION

1. Field of the Invention

This invention relates to exercise equipment, and more specifically to weight lifting benches and apparatuses allowing the use of dumbbells.

2. Related Art

Weight lifting is a popular form of exercise and physical therapy in today's world. The use of dumbbells in one's workout routine is a good means of strengthening biceps, triceps, pectorals, and various other muscle groups. During the performance of such exercise, it is important for lifters to have the means by which to safely workout. A lifter often relies on another person, a "spotter", to assist with a workout to ensure that he/she does not lose control of the dumbbells and injure himself/herself. In the alternative when a spotter is not available, a lifter may use a weight lifting support apparatus while exercising.

The use of conventional support apparatuses and equipment when exercising has certain inherent weaknesses. For example, a standard weight lifting bench may or may not have a barbell cross bar. However, a barbell cross bar does not provide a means by which a lifter can use dumbbells. Therefore, there is a need for a weight lifting apparatus that assists a lifter with exercising with dumbbells so that the lifter does not have to rely on the availability of a spotter.

An example of such a conventional apparatus is U.S. Pat. No. 4,666,150, entitled Dumbbell Position Rack, to Segrist, ("Segrist Patent") which discloses an apparatus comprising a vertical support tower on top of which is mounted a saddle for receiving, supporting and storing a single dumbbell. In operation a lifter must use two such vertical support towers, one on each side of him/her wherein one tower is used for each of the two dumbbells being used.

The Segrist Patent has a major weakness in that a support tower is a single support that is positioned on one side of the lifter. Such a tower is easily knocked over when accidently hit or when a dumbbell is placed on it in a very fast and off-balanced manner, e.g., when a lifter loses control of a dumbbell during a strenuous workout. Depending on the size of the weight being used, serious bodily injury may result from a falling dumbbell and/or tower.

A second disadvantage of the Segrist Patent is that during the normal and anticipated use of the support towers, a lifter must use two separate towers during a workout. Therefore, it is encumbant upon the lifter to place the two towers in the proper position alongside a bench. If the towers are not in proper alignment, the lifter may not be able to comfortably reach the towers or correctly place the dumbbells, or press bar or curl bar, onto the towers when the exercise is complete. In addition, it is very easy to knock one or both towers out of alignment, also resulting in the lifter not having a safe workout or being able to workout without injury.

Therefore, there is a need for a dumbell support apparatus that provides a single integrated structure for supporting two dumbbells, as used during a workout session, that cannot be knocked out of alignment with a misplaced or slipped dumbell. There is also a need for such a dumbbell support apparatus that a lifter can easily use without requiring additional preparation time for equipment setup or additional personnel.

In U.S. Pat. No. 5,616,108, entitled Dumbbell Support Attachment for Barbell Cross Bar, to Hayden, ("Hayden Patent") an attachment device is disclosed that hangs from a conventional barbell cross bar so that dumbbells can be used with a conventional weight lifting bench. This attachment device is not adjustable to accommodate a lifter's different exercises, nor can it easily accommodate lifters of various size and build or lifters having different hand positions. For example, if a lifter wants to workout using an incline or decline position, the structure of the Hayden device would inhibit or completely prevent the lifter's workout due to its solid bottom portion. Further, in order for the lifter to store dumbbells, the lifter's hands must be properly spaced to fit between the open cutouts because the device is not adjustable. Further, the attachment device of the Hayden Patent cannot work with any conventional weight lifting bench because it only works with a bench having a barbell cross bar from which to hang.

Therefore, there is a need for a dumbbell support apparatus that is easily adapted to any conventional weight lifting bench for supporting the use of dumbbells, bench press bars and curl bars.

SUMMARY OF THE INVENTION

The present invention solves the problems associated with conventional dumbbell support apparatuses by providing a multi-level dumbbell support apparatus having a single frame structure into which two adjustable dumbbell supports are integrated. The frame structure comprises a base and a front pair of vertical supports connected to a rear pair of vertical supports wherein all vertical supports are connected to the base. The frame structure may also incorporate one or more horizontal stabilizing bars to secure the vertical supports and provide a more stable apparatus. A dumbbell support is connected to each of the front vertical supports, thereby providing the means by which a user can exercise with dumbbells or a bench press or curl bar without requiring additional equipment or personnel. To further assist a user, the dumbbell supports are adjustably mounted to the front vertical supports to accommodate different exercises and lifters of varying size and build. In the preferred embodiment, a dumbbell support has a front lip portion, a flat portion, and a rear inclined portion, wherein the front lip portion and the flat portion have an opening cut therein to accommodate a lifter's hand when grasping a dumbbell.

There are many distinct advantages of the dumbbell support apparatus of the present invention. First, the dumbbell support apparatus does not fall over or move out of alignment due to its single frame design. Specifically, the base of the single frame structure has a plurality of extensions which provide a very stable apparatus such that when hit by an out of control weight, the entire support apparatus will not move, or if it does, it will only move very slightly, out of alignment.

Another advantage of the present invention is the shape of the dumbbell supports. A dumbbell support provides the means by which a beginner or a professional weight lifter may use the apparatus of the present invention. That is, whether starting or ending an exercise session, a lifter can easily move a dumbbell over the front lip portion of a dumbbell support of the present invention. The front lip portion is low enough so as to not interfere with racking a dumbbell in the dumbbell support but high enough to keep the dumbbell on the dumbbell support during storage. Second, the rear inclined portion of a dumbbell support provides a lifter with the feeling of a silent spotter such that when a lifter is racking a dumbbell, the rear inclined portion guides the dumbbell into its resting spot on the flat portion.

Third, also in the preferred embodiment, the opening cut into the flat portion of a dumbbell support is free of all sharp edges and covered with a cushioned type of rubber to further prevent injury to the lifter who is not steady in bringing a dumbell back into the dumbbell support. Such a unique design of the dumbbell support also provides for the use of standard bench press and curl bars.

Another advantage of the present invention is the unique combination of the single frame structure having adjustable dumbbell supports incorporated thereon. This combination allows a lifter to perform different exercises from an incline, flat or decline position, including a lifter who wants to perform a military press.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
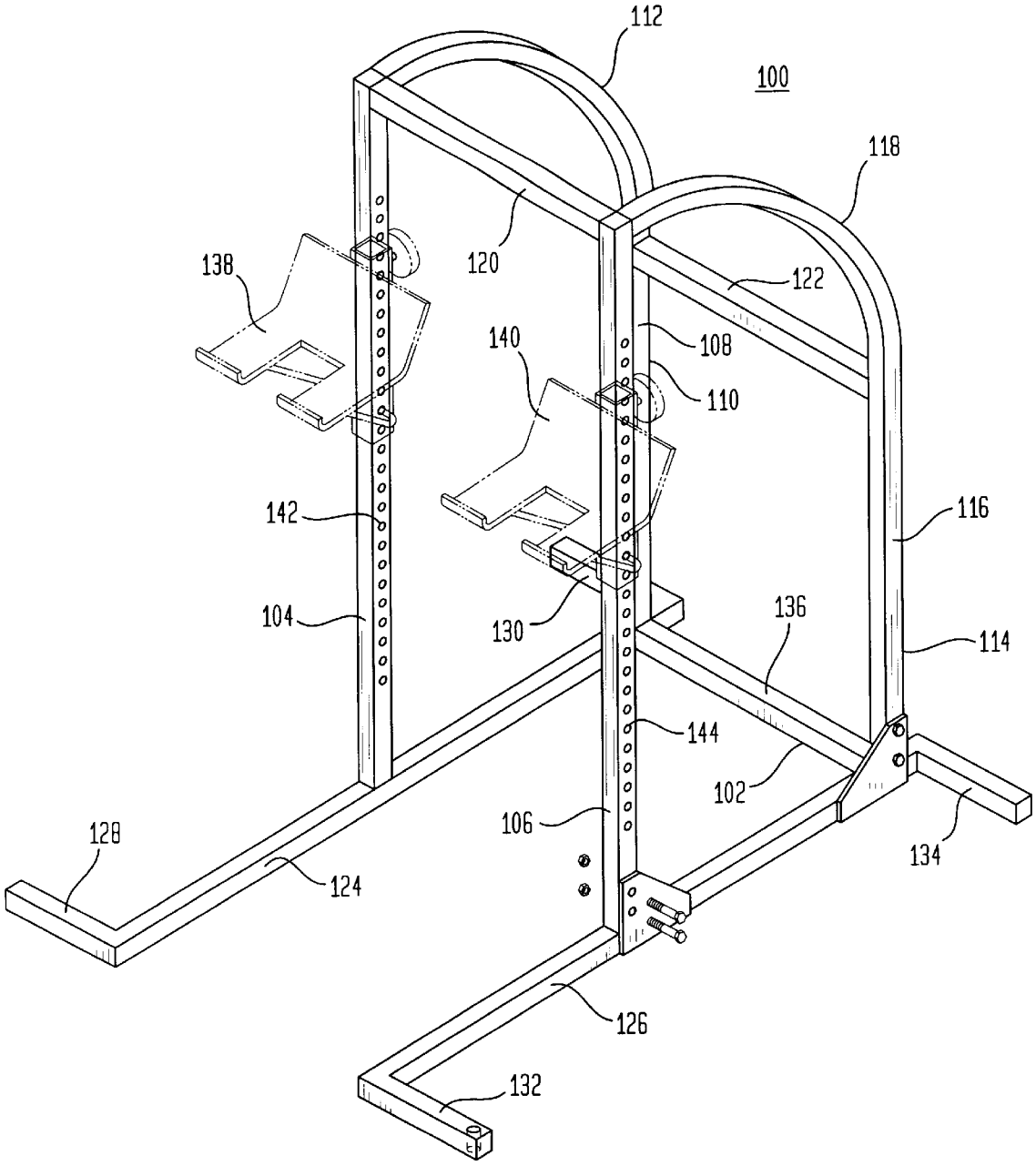
FIG. 1 is a perspective view of a multilevel dumbbell support apparatus of the type embodying the present invention.

FIG. 1 is a perspective view of the preferred embodiment of the multilevel dumbbell support apparatus 100 of the present invention. In the preferred embodiment, the apparatus 100 comprises a single frame structure having a base 102, a first front vertical support 104, a second front vertical support 106, a first rear vertical support 108 having a first straight portion 110 and a first connecting portion 112, a second rear vertical support 116 having a second straight portion 114 and a second connecting portion 118, such that the first front vertical support 104 is connected to the first rear vertical support 108 and the second front vertical support 106 is connected to the second rear vertical support 116.

The apparatus 100 of the present invention also comprises one or more horizontal stabilizer supports. In the preferred embodiment, a front horizontal stabilizer support 120 rigidly connects the first front vertical support and the second front vertical support, a rear horizontal stabilizer support 122 rigidly connects the first rear vertical support 108 and the second rear vertical support 116, and a base horizontal stabilizer support 136 rigidly connects the first base support 124 and the second base support 126. Further, the base horizontal support 136 is located at the rear ends of the base supports 124, 126.

The base 102 of the preferred embodiment comprises a first base support 124 and a second base support 126. Further, the first base support 124 and the second base support 126 have a plurality of extensions for providing additional stability to the apparatus 100. The first base support 124 has a first front extension 128 rigidly connected to a front end of said first base support 124 and a first rear extension 130 rigidly connected to a rear end of said first base support. The second base support 126 has a second front extension 132 rigidly connected to a front end of said second base support 126 and a second rear extension 134 rigidly connected to a rear end of said second base support 126. In the preferred embodiment the extensions 128, 130, 132, 134 protrude in an outward direction of the apparatus 100 so as to provide lateral support. The base is described in these terms for convenience purpose only. It would be readily apparent for one of ordinary skill in the art to design and incorporate a base having a different structure while still providing stability to the single frame structure.

The apparatus of the present invention is described in the above terms of a single frame structure for convenience purpose only. It would be readily apparent for one of ordinary skill in the relevant art to design a comparable single frame structure. For example, in an alternative embodiment, the single frame structure may include zero or more horizontal stabilizers or may include a single rear vertical support assembly having a top end rigidly connected to the top end of the first front vertical support and the top end of the second front vertical support and having a bottom end rigidly mounted to the base. Such a rear vertical support assembly comprises one or more rear vertical supports. In one embodiment, the rear vertical support assembly comprises a single rear vertical support having a "Y" shape at its top end, wherein each branch of the "Y," rigidly connects to a top end of a front vertical support.

Also in the preferred embodiment, the distance between the first base support 124 and the second base support 126 is approximately 2'6" within which most conventional weight benches can fit, either forwards or backwards. This distance also allows a user to transport the apparatus 100 of the present invention through any conventional door of a gym or home after simply removing the base 102.

The apparatus 100 of the present invention further comprises a plurality of dumbbell supports 138, 140, wherein a first dumbbell support 138 is adjustably connected to the first front vertical support 104 along a first plurality of holes 142 and a second dumbbell support 140 is adjustably connected to the second front vertical support 106 along a second plurality of holes 144. In the preferred embodiment, each dumbbell support 138, 140 is connected to a front vertical support 104, 106 by a double locking system. The double locking system of the present invention is described in greater detail below.

For convenience purpose only, the dumbbell supports 138, 140 shall be described in terms of a single dumbbell support 138. All descriptions of one dumbbell support 138 are equally applicable to the other dumbbell support 140 of the present invention.

Figure 2:
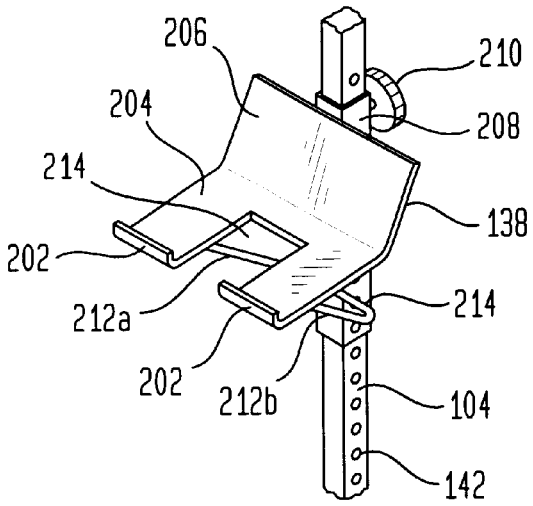
FIG. 2 is a perspective view of a dumbbell support of the present invention mounted on a front vertical support.
Figure 3:
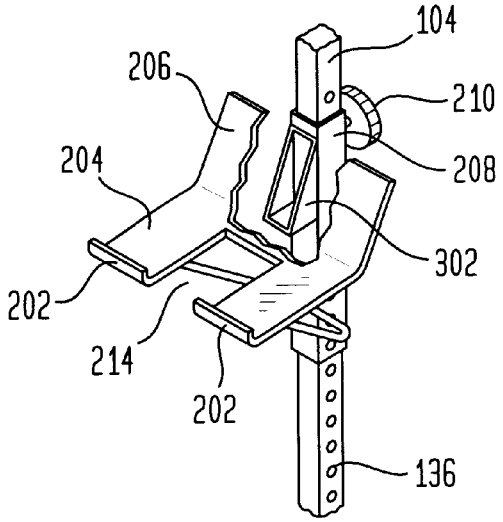
FIG. 3 is a perspective view of the dumbbell support with a cut-away in its rear inclined portion showing the preferred mounting means to a front vertical support.
Figure 4:
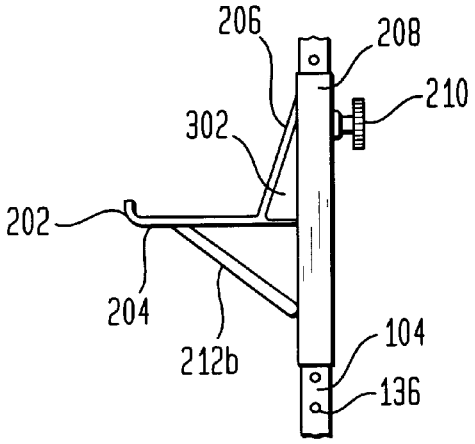
FIG. 4 is a side view of the dumbbell support mounted on a front vertical support.

FIGS. 2–4 illustrate the preferred embodiment of a dumbbell support 138 of the present invention. A dumbbell support 138 has a front lip portion 202, a flat portion 204, and a rear inclined portion 206, wherein the front lip portion 202 and the flat portion 204 have an opening 214 cut therein to accommodate a lifter's hand when grasping a dumbbell. In an alternative embodiment, the sides of the dumbbell support 138 making the opening 214 therein are covered with a rubber cushioning-type, or comparable, material to provide comfort to the lifter.

In the preferred embodiment, the front lip portion 202 of the dumbbell support 138 is approximately one inch in height which is low enough so as to not interfere with a lifter racking a dumbbell, yet high enough so as to store the dumbbell on the dumbbell support 138. Also, the rear inclined portion 206 is approximately a ten degree angle which gives a lifter the sense of an invisible spotter when racking a dumbbell. It would be readily apparent to one of ordinary skill in the relevant art to design a dumbbell support 138 using different heights and measurements so as to accommodate a conventional dumbbell.

In the preferred embodiment, the dumbbell support 138 is connected to the first front vertical support 104 by a double locking system comprising two different locking mechanisms by using a locking sleeve 208 onto which the dumbbell support 138 is attached. The preferred locking sleeve 208 is a hollow tube of metal having a plurality of holes that slides over the first front vertical support 104 wherein the holes 142 of the first front vertical support 104 align with the holes of the locking sleeve 208.

The first locking mechanism of the preferred embodiment comprises a pair of angled supports 212*a,b* rigidly connecting the front bottom of the flat portion 204 of the dumbbell support 138 to a locking pin 214. The locking pin 214 is a metal dowel that fits within the holes of the locking sleeve 208 and the holes 142 of the first vertical support 104, thereby securing the dumbbell support 138 to the first front vertical support 104.

The second locking mechanism of the preferred embodiment is a pressure screw 210 that, when engaged, the pressure screw 210 secures the dumbbell support 138 to the first front vertical support 104 via pressure exerted from the pressure screw 210 on the first front vertical support 138. Pressure screws 210 are well known in the relevant art. It would be readily apparent for one of ordinary skill in the relevant art to design and implement such a locking mechanism.

An additional means of supporting the dumbbell support 138 is a hollow wedge 302 rigidly attached to the front side of the locking sleeve 208. The rear inclined portion 206 of the dumbbell support 138 rests on the locking sleeve 208, thereby providing additional support and stability to the dumbbell support 138 when in use.

The means for connecting a dumbbell support 138 to a front vertical support 104 is described in the above terms of a double locking system for convenience purpose only. It would be readily apparent to one of ordinary skill in the relevant art to adjustably connect a dumbbell support 138 to a front vertical support 104 by using a comparable means for locking.

In operation, a lifter places a weight lifting bench between the first front vertical support 104 and the second front vertical support 106 of the apparatus 100 of the present invention. The lifter then adjusts the first dumbbell support 138 and the second dumbbell support 140 to the correct height for the exercise to be performed. In the preferred embodiment, the lifter makes such an adjustment by positioning a dumbbell support 138 at the correct height and engaging the double locking system. Specifically, the lifter engages the locking pin assembly and the pressure screw 210 to secure the dumbbell support 138 to the front vertical support 104.

When the dumbbell supports 138, 140 are in position, the lifter disposes on each dumbbell support 138, 140 a dumbbell of a desired weight. The lifter then positions himself/herself on the weight lifting bench and exercises with the dumbbells.

The preferred embodiment of the apparatus of the present invention is manufactured using 2" square steel tubing having ⅜" or ½" diameter holes 142, 144 for connecting the dumbbell supports to the front vertical supports, however, this is only for convenience purpose. It would be readily apparent to one of ordinary skill in the relevant art to manufacture the apparatus 100 of the present invention using a comparable material. Further, all references to dimensions are for convenience purpose only. It would be readily apparent to one of ordinary skill in the relevant art to manufacture the present invention using different dimensions and achieve the same functional results.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the following claims and their equivalents.

What is claimed is:

1. A weight lifting apparatus for supporting a dumbbell, being adapted for use with a weight lifting bench, comprising:

a base having a first base support and a second base support;

a first front vertical support having a top end and a bottom end, the bottom end being rigidly mounted to said first base support wherein said first base support extends beyond said first front vertical support;

a second front vertical support having a top end and a bottom end, the bottom end being rigidly mounted to said second base support wherein said second base support extends beyond said second front vertical support;

a rear vertical support assembly having a top end and a bottom end, the top end being rigidly connected to the top end of said first front vertical support and to the top end of said second front vertical support, and the bottom end rigidly mounted to said first base support and said second base support;

one or more dumbbell supports, each said dumbbell support having a front lip portion, a flat portion and a rear inclined portion, wherein said front lip portion and said flat portion have an opening cut therein to accommodate a lifter's hand when grasping the dumbbell; and a means of connecting said dumbbell supports to said first front vertical support and said second front vertical support comprising a pressure screw system, wherein said pressure screw system further comprises a pair of angled supports and a locking pin, wherein said pair of angled supports rigidly connect the bottom of one said dumbbell support to said locking pin and said locking pin is removably attached to one said front vertical support.

2. The weight lifting apparatus according to claim 1, wherein said rear vertical support assembly comprises:

a first rear vertical support having a top end and a bottom end, the top end rigidly connected to the top end of said first front vertical support, and the bottom end rigidly mounted to said first base support; and a second rear vertical support having a top end and a bottom end, the top end rigidly connected to the top end of said second front vertical support, and the bottom end rigidly mounted to said second base support.

3. The weight lifting apparatus according to claim 1, wherein said means of connecting said dumbbell supports is adjustable.

4. The weight lifting apparatus according to claim 1, further comprising one or more horizontal stabilizers.

5. The weight lifting apparatus according to claim 1, further comprising a base stabilizer rigidly connecting said first base support and said second base support.

6. The weight lifting apparatus according to claim 1, wherein said first base support comprises a first front extension and a first rear extension, and said second base support comprises a second front extension and a second rear extension.

7. The weight lifting apparatus according to claim 1, wherein said front lip portion of said one or more dumbbell supports is about one inch in height.

8. The weight lifting apparatus according to claim 1, wherein said rear inclined portion of said one or more dumbbell supports is about a ten degree incline.

9. The weight lifting apparatus according to claim 1, wherein said means for connecting said dumbbell supports to said first front vertical support and said second front vertical support comprises a locking pin assembly.

10. The weight lifting apparatus according to claim 1, further comprising a means for cushioning said opening of said one or more dumbbell supports.

11. The weight lifting apparatus according to claim 1, wherein said rear vertical support assembly comprises a single rear vertical support having a top end and a bottom end, wherein the top end is "Y" shaped.

12. The weight lifting apparatus according to claim 1, wherein said pressure screw system comprises a locking sleeve having a front and a back and a pressure screw, wherein one said dumbbell support is rigidly attached to the front of said locking sleeve and said pressure screw is movably attached to the back of said locking sleeve.

13. The weight lifting apparatus according to claim 12, wherein said pressure screw system further comprises a hollow wedge having an inclined front and a straight back, the straight back of said hollow wedge rigidly attached to the front of said locking sleeve and the inclined front of said hollow wedge rigidly attached to the back of said rear inclined portion of one said dumbbell support.

* * * * *